United States Patent [19]

Cantrell et al.

[11] Patent Number: 4,773,436

[45] Date of Patent: Sep. 27, 1988

[54] POT AND PAN WASHING MACHINES

[75] Inventors: John W. Cantrell; Thomas D. Gault, both of Overland Park; William R. Cantrell, Leawood, all of Kans.

[73] Assignee: Cantrell Industries, Inc., Olathe, Kans.

[21] Appl. No.: 23,145

[22] Filed: Mar. 9, 1987

[51] Int. Cl.[4] ..... B08B 3/04

[52] U.S. Cl. ..... 134/108; 134/111; 134/182; 134/186; 134/195; 134/199

[58] Field of Search ..... 134/89, 90, 100, 108, 134/111, 182, 186, 195, 198, 199, 200

[56] References Cited

U.S. PATENT DOCUMENTS

| | | | |
|---|---|---|---|
| 659,278 | 10/1900 | Argenbright | 134/198 |
| 803,097 | 10/1905 | DeLaney | 134/108 X |
| 1,033,961 | 7/1912 | Staines | 4/638 |
| 1,266,167 | 5/1918 | Sears | 134/199 X |
| 1,299,698 | 4/1919 | Fitzgerald | 134/198 |
| 1,545,979 | 7/1925 | Rosenberg | 134/104 |
| 1,691,839 | 11/1928 | Caskin | 134/60 |
| 1,826,015 | 10/1931 | Morton | 134/111 |
| 1,961,548 | 6/1934 | Caise | 134/111 X |
| 2,442,272 | 5/1948 | Jaffa | 134/108 |
| 2,576,236 | 11/1951 | Paden | 134/111 X |
| 2,619,097 | 11/1952 | Von Bromssen | 134/57 D |
| 2,651,311 | 9/1953 | Rule | 134/89 |
| 2,675,012 | 4/1954 | Scales | 134/85 |
| 2,739,781 | 3/1956 | Lyman | 134/199 X |
| 2,764,171 | 9/1956 | Nolte | 134/108 X |
| 2,808,842 | 10/1957 | Pollock et al. | 134/111 X |
| 2,867,225 | 1/1959 | Zademach et al. | 134/108 X |
| 3,020,918 | 2/1962 | Albertson et al. | 134/98 |
| 3,074,078 | 1/1963 | Varian | 134/111 X |
| 3,276,459 | 10/1966 | Harrison | 134/111 X |
| 3,308,839 | 3/1967 | Barday | 134/76 |
| 3,343,555 | 9/1967 | Kasner | 134/111 |
| 3,345,994 | 10/1967 | Felton | 134/111 |
| 4,092,176 | 5/1978 | Kozai et al. | 134/186 |
| 4,135,530 | 1/1979 | Cheney | 134/60 |
| 4,156,621 | 5/1979 | Andrews et al. | 134/109 X |
| 4,213,474 | 7/1980 | Harrison | 134/102 |
| 4,442,851 | 4/1984 | Holm | 134/106 |
| 4,672,985 | 6/1987 | Mohr | 134/57 R |

FOREIGN PATENT DOCUMENTS

| | | | |
|---|---|---|---|
| 2098749 | 3/1972 | France | 134/111 |
| 997624 | 7/1965 | United Kingdom . | |

*Primary Examiner*—Philip R. Coe
*Attorney, Agent, or Firm*—Thomas M. Scofield

[57] ABSTRACT

Improvements in pot and pan washing machines (as opposed to dishwashing machines and drinking glass washing machines); a device adapted to receive large pots and pans used in cooking operations in a restaurant or the like which is downstream, typically, in the work process of cleaning pots and pans, from an initial scraping and scrapping tank, then, typically, is followed by a rinsing tank, the latter then followed by a sanitizer tank; a pot and pan washer tank utilizing a multiplicity of relatively high velocity, underwater, spaced apart water input jets on one wall thereof which provide a tank-wide circulating flow from upper back to lower front and then upwards and back within the tank from the front wall, the jet nozzles being positioned below the operating water level, there preferably being an overflow opening above the jet nozzles and pipes associated therewith, a pump circulating water from a lower portion of the tank at one side thereof to the noted jet nozzles, a faucet being preferably provided above said overflow opening for intially filling or refilling the tank and controlling the level of water therewithin for various purposes involved in the carrying out of the washing of the pots and pans; improvements in pot and pan washing devices where relatively unclean pots and pans from a scraping and scrapping tank or operation may be continuously fed into such device which continuously operates, the clean or more clean pots and pans, after an interval therewithin; continuously being removed from said tank to be passed to a rinsing step.

43 Claims, 2 Drawing Sheets

POT AND PAN WASHING MACHINES

BACKGROUND OF THE INVENTION

In pot and pan washing operations (which are to be strictly distinguished from dishwashing and glass washing operations) in a restaurant or the like, typical common requirements by local departments of health include at least a wash tank, a rinse tank and a sanitizing tank. A used pot and pan scraping and scrapping operation to initially clean substantial food residues and grease therefrom of some sort may also typically precede the wash tank. The subject improvement is designed to preferably (but not necessarily) be operated as one of four cooperating and longitudinally aligned tanks. The first of these is a scraping and scrapping tank where scraping utensils and high velocity water sprays (the latter typically being spray heads on hoses manipulatable by hand) enable the substantial removal from used pots and pans taken from cooking and/or food dispensing operations of the major residues and crusts of foods cooked in and/or dispensed from the pots or pans. Additionally, the major quantity of any grease contained within said pots and pans is additionally typically substantially removed in the said first scrapping and scraping tank.

The subject washing device preferably follows the scrapping and scraping tank operation, receiving therein the initially treated pots and pans, such typically still with some lesser food residues and grease thereon. This washing apparatus or tank is a device which is so constructed and operated as to create a relatively powerfully circulating body of water therein, such moving from elevated input nozzles on the back wall thereof to the front of the bottom wall, thence to the lower and center front wall, therefrom to rise and return back across the upper tank and water surface toward the back wall. A series of spaced apart, elevated jet nozzles are provided on the rear wall below the normal water level in the tank. An overflow opening is preferably provided somewhat above said jet nozzles also on the rear wall of the tank. A pump on one side wall of the tank intakes circulating water and detergent mix from the tank and pumps it back into a manifold connecting to the jet nozzles. A faucet for changing the level of water in the tank and/or initially filling or refilling the tank, after emptying thereof, is preferably provided in the rear wall above the overflow opening. There is a central drain in the bottom wall. A perforated screen mesh which is insertable in and removable from the tank preferably removably encloses the pump intake connection and any heating element provided in the tank from circulating food and material particles, as well as impacts from pots and pans being inserted in and/or removed from the tank.

After a certain time interval of soaking, washing and cleaning of the said pots and pans in the subject pot and pan washer tank, the washed pots and pans are removed by hand from the said washing tank and then dipped several times into a rinse tank before being passed into a sanitizer tank which typically utilizes an iodine solution therefor.

The optimum pot and pan washing device, of which the present invention is an example, performs all of the functions, of pot and pan washing, including optimally circulating and handling the detergent containing water in the tank, providing for periodic excess grease removal from such circulating water/detergent mixture and the necessary emptying and refilling of the tank itself.

BRIEF DESCRIPTION OF THE INVENTION

The subject pot and pan washing device basically embodies and comprises a tank having substantially rectangular bottom, side, front and rear walls connected at substantial right angles to one another, so as to be substantially rectangular in plan view from above. The side, front and rear walls are normally substantially vertical and the bottom wall normally substantially horizontal in orientation. A drain opening is provided in the substantial center of the bottom wall with a first drain pipe connected thereto and leading downwardly away therefrom. The drain opening has a valve associated therewith operable to open and close the drain opening, thus to be able to readily fill and empty said tank.

A plurality of preferably substantially uniformly spaced apart liquid dispensing pipes and nozzles thereon are provided on the rear wall, extending therethrough into said tank. The pipes and nozzles are all preferably positioned at substantially equal distances from one another and preferably also the side walls of the tank. An overflow opening is preferably provided in said rear wall, positioned above said liquid dispensing pipes and nozzles, there being a second drain pipe connected to said overflow opening on the outside of said tank. The second drain pipe connects to the first (and main) drain pipe below the valve at the drain opening in the bottom wall. A pump having an intake connection through one of said side walls slightly above the bottom wall and substantially below said nozzles is provided, said pump also having an output connection therefrom extending to or adjacent to said rear wall. A manifold connects together all of said liquid dispensing pipes and nozzles, said manifold positioned behind the rear wall and having the pump output connection communicating therewith. In this manner, liquid is pumped from a lower level of said tank into the input pipes and nozzles thereabove for controlled circulation and recirculation of water in said tank.

A heating element is preferably provided connecting through said front wall and extending rearwardly in said tank preferably adjacent to the side wall having the pump intake connection therewithin. Said heating element is preferably positioned in one of the lowest portions or zones of said tank. At least one faucet is preferably provided on said back wall with hot and cold water pipe connections thereto extending through said rear wall, there being valves on said hot and cold water pipes to enable control of the quantities of liquid flow therethrough and into said faucet. A first, removable, finely perforated screen is preferably provided at and adjacent to the side wall carrying the pump intake connection, this screen removably enclosing therewithin the said heating element and said pump intake connection.

With respect to the above described elements, the heating element is preferably positioned below or opposite said pump intake connection, the latter being preferably positioned substantially below said pipes and input nozzles, the latter preferably being positioned below said overflow opening and the latter being positioned below said faucet.

The pump intake connection and said overflow opening are preferably positioned at substantially opposite ends of said tank. A second, typically fixed, perforated screen is most preferably positioned over said pump intake opening within the first removable perforated screen. The front and side walls of the tank are all preferably substantially the same height with the nozzles and overflow opening positioned below the tops of said front and side walls.

The rear wall of the tank is preferably of greater height than the other tank side and front walls and, preferably, the faucet is positioned thereon also above the tops of the tank side and front walls.

The said input nozzles are optimally directed and so powered by the pump that the jets or streams of water therefrom, in the body of water in the tank, if not deflected or impeded in said tank volume by pots and pans positioned therewithin, will actually reach and impact on said bottom floor closely adjacent said front wall lower edge and thence, deflected, impact upon the lower and middle part of the front wall.

Preferably, the connections between the front and bottom walls and rear and bottom walls inside said tank are both faired, filleted or rolled along their length to tend to deflect liquid impacting thereagainst forwardly and upwardly at the front wall and forwardly and downwardly at the rear wall.

The pot and pan washing device is so designed that it readily may be constructed for a flow of pots and pans from the right to the left therethrough or, alternatively, from the left to the right therethrough merely by reversal of certain parts therewithin and thereon.

OBJECTS OF THE INVENTION

A first object of the invention is to materially improve known pot and pan soaking and washing machines or devices.

Another object of the invention is to provide a pot and pan washing device or tank wherein all of the operations necessary within a pot and pan washing tank take place therein in an optimum fashion and all of the apparatus and devices required to carry out said necessary operations are optimally positioned, spaced and related to one another to best cooperate in the function and use of the device.

Another object of the invention is to provide a pot and pan washing device which is readily and easily initially filled to a level above the jet nozzles employed therewithin and preferably below or at the optional overflow opening thereof, with the soap or detergent containing water within said tank operative to be circulated, first, within the tank in an optimum circular pattern to best clean and wash the pots and pans therein and, secondly, outside the tank, by pump from a lowermost zone in one side of the tank to the jet nozzles driving and circulating water within the tank.

Another object of the invention is to provide a unique means for protecting the circulating pump intake connection to the tank from gathering food particles therein which would block said jets, as well as, optionally, protect any heating element utilized in the tank from impacts by pots and pans being placed in and removed from the tank.

Another object of the invention is to provide such a pot and pan washing device which is not only highly efficient and effective in carrying out its purpose, but also extremely economical to operate and of minimum cost and maximum simplicity of construction for carrying out the task for which it is designed.

Still another object of the invention is to provide the parameters of optimum positions for the members of an array or pattern of parts within a pot and pan washing device or tank wherein the height and relative positions of the jet nozzle inputs, the recycle pump intake, the heating element, the overflow opening and the water inlet faucet are all optimally positioned with respect to one another depending upon the specific dimensions of the tank.

Yet another object of the invention is to provide such a pot and pan washing tank and device wherein, by simple reversal of parts in construction, the tank may be employed in a right to left movement of pots and pans to be soaked, washed and cleaned therewithin or, alternatively left to right of same.

Other important objects of this invention and device include the great reduction of labor required to clean pots and pans (thus enabling a single utility man to both wash dishes and do the pots and pans, spreading time therebetween), secondly. the considerable improvement of the washing efforts and results on the pots and pans to be cleaned over prior devices and, finally, making the work flow of the kitchen far smoother with respect to handling all of the items therewithin which must be cleaned, washed and recycled for use.

Other and further objects of the invention will appear in the course of the following description thereof.

THE DRAWINGS

In the drawings, which form a part of the instant specification and are to be read in conjunction therewith, an optimum embodiment of the invention is shown and, in the various views, like numerals are employed to indicate like parts.

THE PRIOR ART

Figure 1:
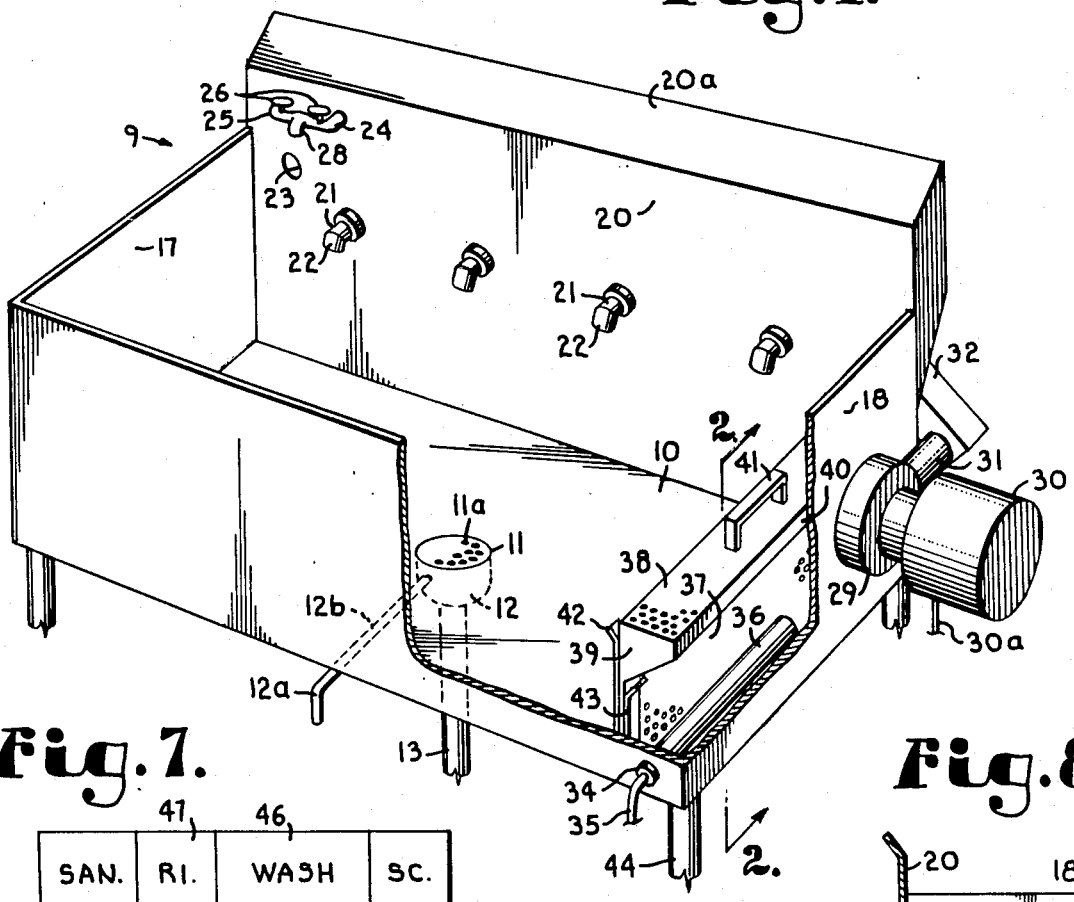
FIG. 1 is a three-fourths perspective view, from above, of a pot and pan washer construction embodying the invention, with a portion of the front and one side walls of the tank cut away to better illustrate certain interior construction details.

Applicant is aware of the following listed prior art directed to tanks for washing various items and devices, including crockery and pots and pans.

Argerbright U.S. Pat. No. 659,278, issued Oct. 9, 1900 for "Photographic Print Washer";

Staines U.S. Pat. No. 1,033,961 "Sink For Washing Crockery", issued July 30, 1912;

Fitzgerald U.S. Pat. No. 1,299,698 "Dishwasher", issued Apr. 8, 1919;

Morton U.S. Pat. No. 1,826,015 "Food Washer", issued Oct. 6, 1931;

Caskin U.S. Pat. No. 1,691,839 "Dishwashing Apparatus", issued Nov. 13, 1928;

Von Bronsen U.S. Pat. No. 2,619,097 "Dishwashing Machine . . . ", issued Nov. 25, 1952;

Rule U.S. Pat. No. 2,651,311 "Cleansing Apparatus . . . ", issued Sept. 8, 1953;

Scales U.S. Pat. No. 2,675,012 "Washing Apparatus . . . ", issued Apr. 13, 1954;

Lyman U.S. Pat. No. 2,739,781 "Timing Control For Dishwashing Machines", issued Mar. 27, 1956;

Kasner U.S. Pat. No. 3,343,555 "Parts Cleaning Apparatus", issued Sept. 26, 1967;

Cheney U.S. Pat. No. 4,135,530 "Rinsing Tank", issued Jan. 23, 1979;

Also please note British Pat. No. 928,929 to Donald Low published Jun. 19, 1963, as well as British patent specification No. 997,624 "Improvements Or Relating To Domestic Sink Units", the inventor also Donald Low, published Jul. 7, 1965. The latter is a patent of addition to Low U.S. Pat. No. 928,929.

STRUCTURE OF POT/PAN WASHER

Referring to the drawing figures, therein is seen an optimum form of the subject pot and pan washing device with essentially all features useable to increase performance and versatility illustrated therewithin. The device will be described with respect to a typical useful example employing typical, but optional sizes and spacings of the parts thereof. However, the specifically dimensioned example described is not intended to be limiting. Bottom wall 10 is preferably substantially horizontal and, typically, may be four feet long and 28 inches deep. In all cases, it is preferred that walls 16 and 20 exceed walls 17 and 18 in lengths. Wall 10 typically has drain opening 11 therewithin, such preferably centrally placed on the bottom floor 10. Floor 10 may be dished slightly centrally from its periphery, if desired. Attached to the underside of floor 10, under drain opening 11, there is provided fitting 12 which, in its upper portion, contains a conventional closure valve (not shown) for the opening 11. Handle **12*a* on elongate rod 12*b* enables the operator to open and close the valve in fitting 12. Drain opening 11 must be openable upon positive action of the operator to drain the entire tank and closeable in order to retain a liquid full tank for the washing operation. Drain pipe 13 extends downwardly from fitting 12 and communicates with any suitable drain to waste. The lower portion of fitting 12 has connection 14 thereon to receive thereinto pipe 15 which communicates with the overflow opening to be described. Pipe 15, its connection to fitting 12 and the communication thereof through fitting 12 with drain pipe 13** are all aways open.

Bottom wall or floor 10 of the tank (the tank being generally designated as 9) is preferably subtantially rectangular with parallel front and rear edges and parallel side edges thereon. Front wall 16 is connected to the front edge of floor 10 and, in the specific example being described, is four feet long and 20 inches vertically deep. Side walls 17 and 18 are, in the specific example being described, 28 inches long and 20 inches vertically deep. They connect sealingly at their front edges to the side edges of front wall 16 and extend rearwardly at substantial right angles thereto, their bottom edges being sealingly attached to the side edges of floor 10. Side wall 18 has opening 19 (FIG. 4) therethrough, its center being well over 10 inches down from the top of side wall 18 and preferably as far down as is feasible.

Rear wall 20 is connected at its end edges to the rear edges of side walls 17 and 18 and preferably is of greater height than side walls 17 and 18 and front walls 16. In the specific example noted, the rear wall is preferably 27 inches in total height with the top 2½ or so inches thereof optionally rearwardly angled at from 45° to 60° from horizontal as at **20*a*. Such beveling or angling is not necessary, only preferred. Rear wall 20 preferably has, first, a plurality of pipes 21 extending through said rear wall at a position below the top edges of side walls 17 and 18 and front wall 16, such pipes having jet nozzles 22 of conventional type removably affixed thereto. Above pipes 21, yet below the level of the top edges of walls 16–18, inclusive, is optional overflow opening 23 through wall 20. Opening 23 may have a perforated removable cover (not shown) covering same. Above the 20 inch level of walls 16–18, inclusive some three inches or so, optional hot and cold water pipes 24 and 25 penetrate wall 20 with individual hand control valves 26 thereon to regulate the quantity of hot and cold water going into common pipe 27. Faucet 28 extends from the middle of common pipe 27. Alternatively and also optionally, separate faucets may be provided for the hot and cold water pipes 24 and 25**.

Figure 8:
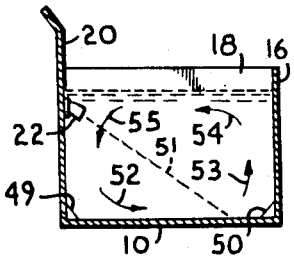
FIG. 8 is a schematic, side, sectional elevation somewhat like FIG. 4, but simplified to show the nozzles on the rear wall, the optimum line of water flow and the fairing, filleting or rolling of the connections between the rear wall and the bottom wall and the front wall and the bottom wall.
Figure 2:
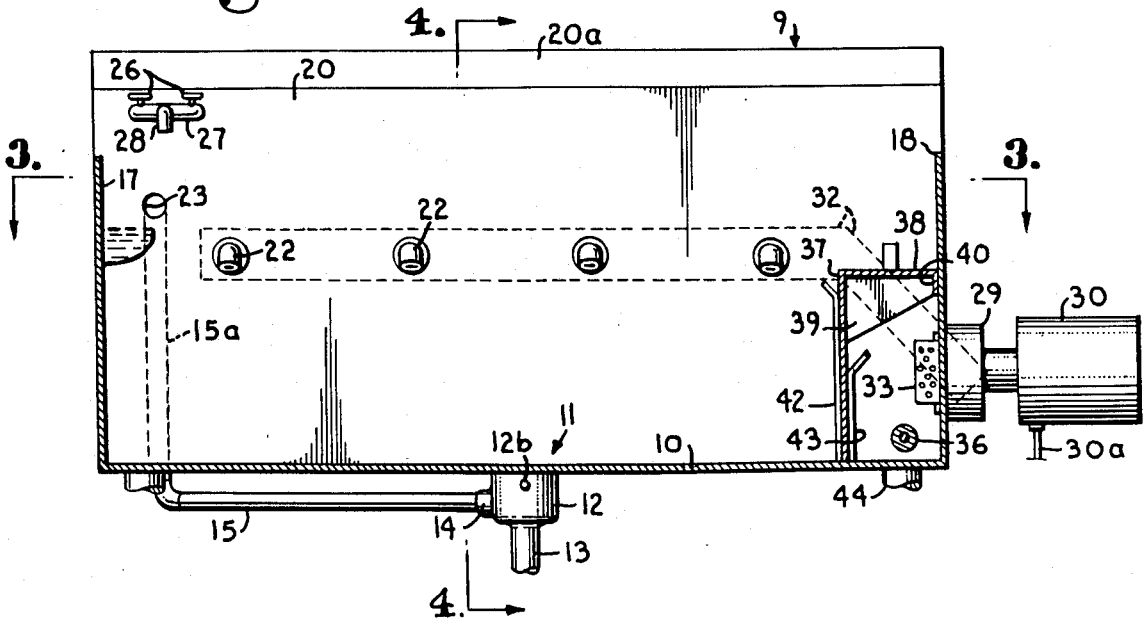
FIG. 2 is a view taken along the lines 2—2 of FIG. 1 in the direction of the arrows.
Figure 3:
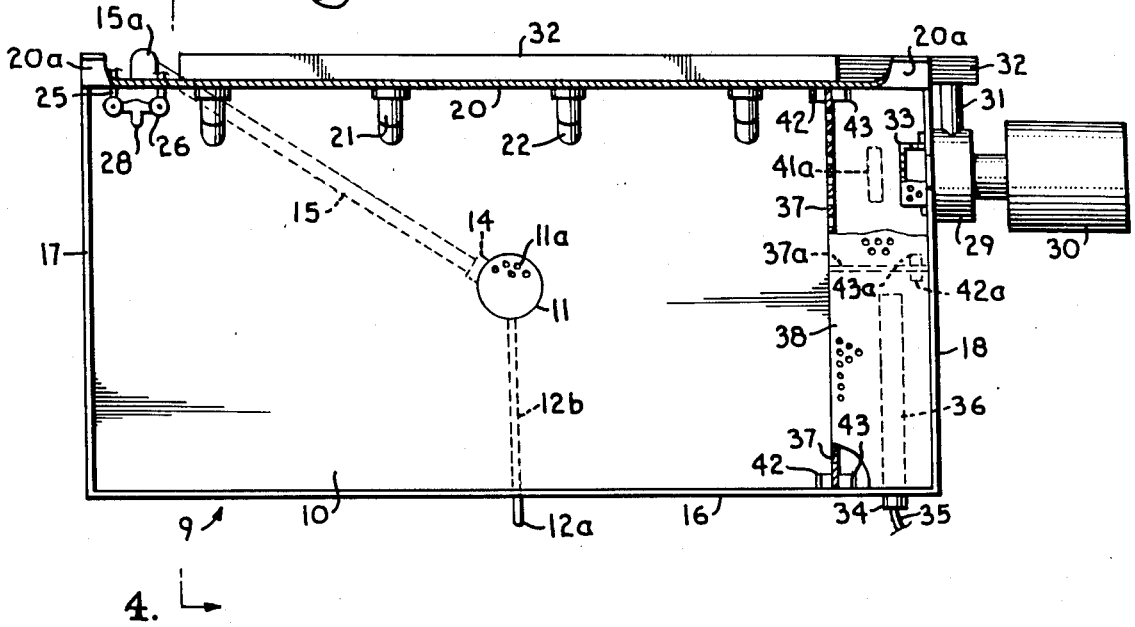
FIG. 3 is a view taken along the line 3—3 of FIG. 2 in the direction of the arrows with, additionally, certain parts of the perforate screen in the right hand side of the view cut away to show certain interior structureal details.
Figure 4:
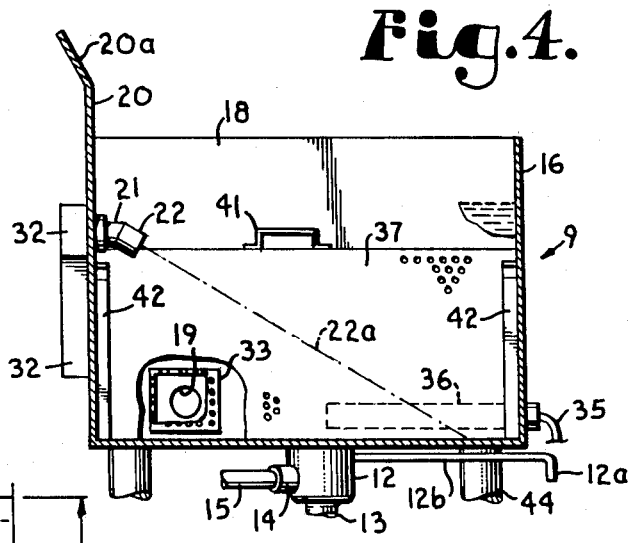
FIG. 4 is a view taken along the line 4—4 of FIG. 2 in the direction of the arrows, there again being a portion of the perforate screen (exterior perforate screen) cut away, as well as a portion of the interior perforate screen, whereby to show the intake pipe or connection to the pump.

With respect to drain opening 11 in floor 10, typically, a removable, perforated, dished disc **11*a* is provided for the drain opening 11. A pipe 15*a* connecting at its upper end to the backside of rear wall 20 around opening 23 optionally extends outwardly from the backside of rear wall 20 and then downwardly to join pipe 15 so that overflow water going into optional overflow opening 23 passes into fitting 12 below the closure valve therein and thence continuously into drain pipe 13. FIGS. 3, 4 and 8 do not show the rearwardly angled upper portion 20*a* of rear wall 20 (as do FIGS. 1 and 2) to indicate that, optionally, rear wall 20** may be entirely vertical.

Returning to side wall 18, pump 29 is driven by electric motor 30 having power cable **30*a* or other power source. The intake pipe of pump 29 inserts into or is bolted onto both sides of opening 19 (FIG. 4) in the lower portion of side wall 18. Pump 29 has discharge line 31 thereform leading to manifold 32 fixed to the rear side of rear wall 20. Manifold 32 extends first upwardly at an angle as seen in FIGS. 1, 2 and 4 and then horizontally as seen in FIGS. 1–4, inclusive. Pump 29 draws water in through opening 19 and drives it through line 31 and manifold 32 into pipes 21 and out of jet nozzles 22 within the tank. Since the optimum operating water level is approximately midway between the level of pipes 21 and the level of optional overflow opening 23 or thereabove, water discharge from nozzles 22 is always below the surface of the water in the tank. Opening 19 in side wall 18 preferably has typically fixed or non-removable, perforated enclosure 33 positioned thereover, operative in operation to prevent any relatively large particles entering opening 19** or any part of an operator's hands.

Fitting 34 extends through an opening in the lower right hand corner of front wall 16 (in the views) in water sealing fashion with power cable 35 electrically connecting therethrough. Optional heating element 36 is of conventional construction and operation, adapted to heat the body of water in which such element is submerged. A flot (not seen) may be employed in the tank to switch off the heating element when the tank empties to a certain level through drain 11. A thermostat (not seen) communicating with the water in tank 9 controls the temperature level at which the heating element switches on and off.

There is preferably provided a perforated enclosure construction which is both removable from and insertable into the tank to partially isolate a limited volume of the tank surrounding heating element 36 (when present) and opening 19 whereby to prevent the incursion of food or other particulate matter into such volume of the tank when the device is operating. If heating element 36 is present, this enclosure preferably also encloses it. The enclosure means includes a vertical inboard wall 37 which is perforated in substantially its entire extent or area and a normally horizontal top wall 38, such also perforated in substantially its entire area. Side braces or flanges 39 and elongate top outside vertical flange 40, all operate to mount and hold horizontal top wall 38 rigidly in position and flat, without dishing, with respect to inboard, vertical wall 37. A handle 41 is preferably provided connected at its ends substantially centrally of rectangular top wall 38, such being adapted to lift and lower the entire enclosure assembly of walls 37–40, inclusive in the tank.

Vertical, inboard, elongate runners 46 are provided on each of the front and rear wall inboard faces opposite one another. Short, outboard, vertical runners 43 are fixed to the front and rear wall inboard faces and spaced slightly outboard from the longer runners 42. By virtue of the parallel sets of runners, which each preferably have outwardly angled top portions, as seen, the end edges of vertical wall 37 may be fitted downwardly between the paired runners 42 and 43 for vertical, removable affixation of the end vertical edges of said wall 37 therebetween. Flanges or panels 39 preferably abut against the inboard faces of front and rear walls 16 and 20, as well as being spaced within the side edges of wall 37. Further, flange 40 preferably sealingly abuts against the inside face of side wall 18 along its entire length between flanges 39 and the front and rear walls 16 and 20. With handle 41, the entire screening assembly 37–41 inclusive, when tank 9 is out of operation, can be lifted out of the tank and sprayed, washed and wiped to clear therefrom any materials or particles caught in any of the perforations in sheets 37 and 38. With this assembly removed, the entire interior of the tank can be hosed and scrubbed down before resuming operation if desired. The entire tank is preferably supported spaced upwardly from any floor surface by corner legs 44.

Figure 7:
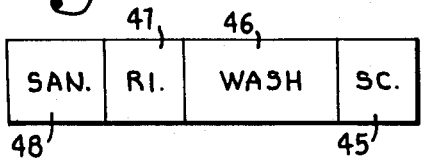
FIG. 7 is a schematic top view of the preferred array of tanks with which the subject inventive washing device is preferably employed, showing specifically, from right to left, a scraping or scrapping tank, the wash tank per se, a rinsing tank and a sanitizing tank.

Referring to FIG. 7, the pot and pan washing tank or assembly 9, which is the subject of the instant application, is usually one of a set of four tanks 45, 46 (for the subject tank), 47 and 48 (FIG. 7). This arrangement assumes that the work of scrapping, washing, rinsing and sanitizing the used pots and pans to be cleaned moves from right to left in the view of FIG. 7 and also from right to left in the views of FIGS. 1, 2 and 3. Specifically, scrapping and scraping tank 45 typically has a perforated tray portion therein for receiving scraped off crusts and food residues from the pots and pans to be cleaned and, as well, one or two separate water hoses with nozzles thereon for spraying down the scraped pots and pans before such are inserted in tank 9. Tank 46 of FIG. 7 is tank 9 of the other figures. Its operation will be described hereinafter in detail. Tank 47 is a relatively narrow rinsing tank into which the washed pots and pans from tank 9 will typically be dipped once or several times (particularly to remove detergent therefrom). Such rinsed pots and pans then are immediately passed into the sanitizer tank 48. In the latter tank, the pots and pans are supposed to remain at least several minutes in a typical iodine disinfecting and sanitizing solution.

It is also important to note that the entire set up illustrated in FIG. 7 is reversible for work flow from left to right. In this case, the scrapping/scraping tank 45 would be on the left, washing tank 46 immediately to the right thereof, rinsing tank 47 immediately to the right of tank 46 and sanitizing tank 48 to the right of the rinsing tank. In such case, the heating element 36, pump 29, pipe 31 and enclosure 37–41, etc. would be placed on the opposite side wall, specifically, wall 17. The overflow opening 23 and faucet assembly 24–28, inclusive, if present, would be moved across the rear wall 20 to the right of the right hand pipe 21 seen in FIG. 1. This is a simple reversal of position of parts and no change in the function to be described would be effected save for the repositioning of the various parts noted.

Referring to FIG. 8, therein is seen a view substantially like that of FIG. 4, but omitting the internal structural details of the subject washing tank. This schematic view is intended to show, as at 49 and 50, the preferred filleting or rolling of the junctures of the rear wall and bottom wall and front wall and bottom wall. Such filleting, fairing or rolling preferably runs the substantial length of the front and rear walls with the optional exception of the zone within the removable perforated sheets 37 and 38. The purpose of such filleting or rounding of the wall junctures is to aid in creating a revolving, circulating movement of the water in the tank when the devise is in action, so that circulation will pass from the nozzles 22 towards a floor impact point just short of fillet 50, thence somewhat upwardly inside of and against front wall 16, then upwardly and rearwardly deflected from front wall 16 back toward rear wall 20. From impact on rear wall 20, the circulating water, including the continuous nozzle 22 input, flow down and back to the front of the tank aided by impact on rear wall 20 and further entrainment in or with the continuous streams of water from jets 22. The preferred direction of the jet paths in the tank (assuming no pots or pans are in the way deflecting the streams) is seen in the dotted line 51, also see FIG. 4 line **22*a*, while the arrows 52–55**, inclusive show the continuous current circulation path within the tank in its ideal form.

Jet nozzles 22 are positioned entirely underwater at least an inch or an inch and half so that all flow therefrom is under the water surface to avoid splashing of streams of water on and from the top surface of the body of water in the tank and also to minimize and avoid deflections/jets from the jet flow impact from one or more nozzles on particular pots and pans in the tank going up into the air.

OPERATION

As previously mentioned, before operation is started, the tank is filled to either the bottom level of the optional overflow opening 23 or between the top of input pipes 21 and the bottom of the said optional overflow opening 23. In any case it is filled above nozzles 22. As the tank is filled with pots and pans to be washed or soaked or receives pots and pans, one or more at a time, the water level will rise somewhat by displacement and, when it reaches the overflow opening, if such is present, start draining therethrough. Preferably, the circulation is set up in the tank by first filling the tank through faucet 28, then starting motor 30 to drive pump 29 whereby, before any pots or pans are entered into the tank, the ideal circulation pattern is set up as previsouly described. The screen 37–41 inclusive etc. is in place. As the water may cool from a desired initial heat level produced by the input through faucet 28, heating element 36 is energized by any conventional heat sensor/-thermostat in and associated with the tank (not shown). The sensor would preferably be within the screened zone under and behind sheets 38 and 37. At this time, also, suitable nonsudsing detergent or other cleaning material is added to the body of water to bring it up to the desired detergent level or strength. If the initial water level is at the bottom edge of overflow opening 23, the simple act of initiating circulation will usually cause some drain of water from the tank overflow opening 23, if present. During the filling of the tank and operation thereof, the valve under drain opening 11 in fitting 12 is closed. The entire tank is also preferably cleaned (hosed down and brushed) and disinfected from any previous activity before a new cycle is started. Understanding thta the subject tank may be employed for other purposes then cleaning pots and pans, such as cleaning machine parts, it should be realized that the washing may run many hours before replacement of the cleaning solution, including over night.

As the tank is filled with pots and pans or receives pots and pans one by one or in groups, the water level tends to rise and, when it reaches overflow opening 23, start draining. Grease tends to rise to the top of the body of water somewhat even in circulation thereof so that any overflow water in the washing operation tends to be grease containing. As pots and pans are removed from tank 9, without replacing same, if such is the case, the water level in the tank will tend to drop. At this time, the operator may bring in new hot water through faucet 28 (and detergent) to achieve the desired level above the pipes 21 and below the overflow opening 23. When there appears to be an excess of grease within the water in the tank (intermediate the actual full drainings, cleanings and refilling of the tank), all or most of the pots and pans may be removed and the tank filled up to and past the overflow opening level. Circulation is stopped and, in the quiescent body of water in the tank, the grease will rise to the water body surface and tend to go out the overflow opening. Water can be continuously added through the faucet 28 or intermittently during this process whereby to, in effect, scavenge the major quantity of the grease out of the tank 9 while the circulation is off.

Typically, a detergent solution is used in the tank 9 with water which detergent preferably is nonsudsing.

The tank is preferably run liquid full as stated with the water surface over nozzles 22 as it is desirable not to pull air into the tank or the circulatory system. A further reason for this is that it is not desirable to have the water so turbulent as to tend to form suds.

A specific pump useable in one standard model of the subject tank four feet in length by 28 to 30 inches in horizontal depth and 20 inches in vertical depth is rated at a circulation of 300 to 320 gallons per minute. Too much jet pressure may allow the water to roll over front wall 16 which is undesirable, the extra height in the rear wall is to avoid the water running over the rear wall, also offering the opportunity to support the plumbing provided to the water input pipes 24 and 25 leading to faucet 28, as well as manifold 32.

The device, once started, is generally left running and pots and pans are sequentially loaded into the tank and unloaded therefrom during this continuous run. The cleaned pots and pans are pulled out one by one, rinsed and then sanitized in tanks 47 and 48.

As previously mentioned, one standard model is four feet long by 30 inches horizontally deep and 20 inches vertically deep. A variation of this model would be four feet long by 28 inches horizontally deep and 20 inches vertically deep. This different horizontal depth measurement enables the handy carrying in of the tank through 33 inch wide doors. Yet another useful model would be three feet long, 28 to 30 inches horizontally deep and 20 inches vertically deep. Obtaining work space of greater length than horizontal depth is usually relatively easy but the latter the horizontal depth of the workplace may be quite limited (for example, in a hallway).

On a standard 20 inch deep tank, walls 16–18 inclusive, the center of the overflow opening 23, if present, is optimally located 17 inches from the bottom of the tank. The centers of the jet nozzle 22 discharge openings are optimally 13 inches from the bottom of the tank. The faucet water input pipes 24 and 25, if present, are preferably spaced several inches above the top edges of walls 17, 18 and 16. With respect to the example being discussed, if rear wall 20 extends 7 inches above the other tank walls, the beveled top portion (if present) is two and a half inches or so in height and, typically, the faucet inlet pipes 24 and 25 (if present) two inches below the start of the angle or bevel.

Strong pressure is required to force the input jet water completely across the tank and effectively accomplish the washing and cleansing job, as well as effect the loop or essentially circular type circulation desired (FIG. 8). All water in tank 9 must be constantly moving in the washing operation. The less the numbers of pots and pans in tank 9, the less general turbulence, typically, there is.

As noted, moving water should be present in the entire volume of the tank independent of the presence or not (or loading in or out) of pots and pans being cleaned or washed. The jets from the nozzles 22, where not completely deflected by a pot or pan surface, should hit the bottom wall 10 just before the angular impact on front wall 16 to then rise and circulate rearwardly toward rear wall 20 and overflow opening 23. As noted, it is most important to have the water moving in a rolling, fully circulating pattern, not a mere aimless dispersal of the water jets into the body of water. Typically, when the tank circulation is started up initially, before pots and pans are added, there is a rise in the water level at the front of the tank and thus wall 16 must be high enough and the flow velocity low enough that this water does not roll over the front wall 16 of the tank.

The angles of the jets from nozzles 22 is related to both the depth of the tank therebelow (water depth therebelow) and the positioning or aiming of such nozzles whereby to have the (unimpeded) water jets strike, in strong action or movement, the front of the bottom wall 10 shortly before the bottom of the front wall 16.

Despite periodical removal of grease from the water/detergent mix in the tank periodically, in the manner previously described, the continued washing of food particle bearing materials from the pots and pans aggregates such material and food particles in the tank water. Most of this is dissolved and the look of this water generally determines when draining and filling of the tank is required. Screens 37 and 38 tend to prevent at least the larger food material particles from entering the zone of the heating element 36 and pump intake 29/19. Eventually, despite the large area of the perforated screens 37 and 38 and presence of inner perforated screen 33, the outer screens 37 and 38 are going to become seriously clogged and thus inhibit the necessary powerful, continuous circulation of water in the path previously described. At this point it is necessary to first shut down circulation by turning off power source 30 for pump 29. Then, with quiescent water in the tank, the grease is preferably first scavenged from the water in the tank as much as possible assuming overflow opening 23 is present.

At this time screen type scoops may be employed to gather food and other material particle residues that tend to fall to the bottom of the tank upon ceasing of circulation in the tank. At any rate, whether the latter is employed or not, the valve in fitting 12 is opened and the water in the tank drained out through opening 11, fitting 12 and pipe 13. Suitable action must be taken to clear the perforations in lid 11*a* so that the water may drain, if particulate matter remains. Once the water has been fully drained from the tank, the bottom and inner side walls and rear wall of the tank may be wiped and/or brushed and sprayed down in order to clear them of grease and food residues and such may be collected before passing into opening 1. It should be noted that, upon turning off of the pump 29, water in manifold 32 and pipe 31 drain into the tank through opening 19 when the tank water level falls sufficient. At this point, a spray jet on a hose may be connected to faucet 28 or some other water source and the entire inside of the tank, including the screens 37 and 38 may be sprayed and scrubbed down. Either before or after this is done, the screen assembly 37–41 may be lifted out of the tank for separate cleaning, inside and out.

After the entire inside of the tank has been cleaned, as well as the screen assembly 37–41, inclusive, the tank preferably will be disinfected, the screen assembly 37–41 replaced (as well as screen assembly 33, if it has been separately removed and cleaned) and the valve in fitting 12 closed to retain water within the tank. The process of filling the tank with hot water/detergent mix is then carried out in the manner previously described. Circulation is then set up through the pump 29 and the nozzles 22 in the clean water and the clean tank prior to beginning the insertion of pots and pans to be further cleaned after the scraping and scrapping operation.

SIMPLER VERSIONS OF THE SUBJECT DEVICE

The device, as seen in FIGS. 1 through 4, includes all of the optimum (as well as necessary) features for the washing and soaking tank of the invention and improvement in those views. However, considerably simplified versions of this device may also be employed to advantage. First, for example, the faucet assembly 24–28, inclusive can be removed from the rear wall. In such case, a pivoting elongate faucet from the rinse tank (see FIG. 7) can also be used to fill and adjust the water level in the washing tank. The same thing is true with respect to the sanitizer tank 48. That is, a pivotal faucet from rinsing tank 47 can also be swiveled over to the sanitizer tank, if long enough, and be used to fill it or adjust the water level therein.

Secondly, while it is most desirable to have the overflow opening 23 with its outlet pipes 15*a* and 15 provided in the tank below the top level of walls 16–18, inclusive, such is not absolutely necessary. What opening 23 does is automatically drain water, water/grease or grease reaching opening 23 in the operation of the device in question, whether the circulation process is going on or not. However, if desired, all draining of the tank 9 can take place through bottom drain 11. Overflow opening 23 likewise protects tank 9 against overfilling or overflow, per se.

Likewise, it is not necessary that the height of rear wall 20 exceed the height of walls 16–18, inclusive. For example, a rearwardly running horizontal platform at the top height of walls 16–18, inclusive can be employed as the top of rear wall 29 to cover manifold 32, space the rear of the tank from any wall surface adjacent thereto and also optionally receive a faucet connection therewithin with the faucet nozzle extending forwardly of the platform, rear wall 20 and over tank 9. In such variation, the overflow opening 23 and its pipes 15*a* and 15 may or may not be included.

It should also be understood that heating element 36 is not absolutely necessary. The water in tank 9 may be maintained at a desirable level of heat simply by periodic input and inflow from either faucet 28 or a faucet on the adjacent rinsing tank 47. Since this is the case, it is not necessary to have a float valve or contact as previously described to automatically turn off the heating element 36 when the water level in the tank drops close to the top of element 36. Likewise, a thermostat control would not be required to activate the element 36 to maintain a certain level of temperature in the tank.

In the latter case, it thus may be seen that a foreshortened outer perforated set of walls 37–41 inclusive surrounding only the intake opening 19 may be provided as seen in the upper right hand corner of FIG. 3 with optional end perforated wall 37*a* and optional receiving guides 42*a* and 43*a*. However, if the heating element 36 is employed, it most preferably, by far, is received within the entire screen array 37–41, inclusive to protect it from impacts by pots and pans, as well as hand contact by the operator. If the arrangement is as stated, without the heating element, the handle 41 would be moved upwardly in FIG. 3, centered over the top wall 38 as seen at 41*a*.

While it is most preferred in all cases, the screen protector structure 37–41, inclusive need not absolutely be provided, whether or not heating element 36 is provided. In the former case, the protection of the heating element against impacts with pots and pans is important.

In the latter case, it is most desirable to have two levels of screen wall protection with respect to the opening into the pump intake to minimize any passage into the manifold of materials which could clog jets 52. However, only the screen portion 33 around the opening 19 is absolutely necessary. This, typically, is rigid and not removable without removing the pump connections to wall 18.

While it is certainly most desirable, it is not absolutely necessary that each of the pipes 21 and nozzles 22 be precisely on the same vertical level. They can be staggered somewhat upwardly and downwardly with respect to one another with fairly good results. They are also preferably evenly spaced laterally from one another, but such precise spacing is also absolutely necessary. Such are also preferably evenly spaced from the side walls 17 and 18, although, again, this is not absolutely necessary.

The bare minimum of the subject inventive apparatus is an elongate rectangular tank having, on the rear wall thereof, a plurality of spaced apart, jet input nozzles which drive water in a pattern as seen at line 51 in FIG. 8 and line 22*a* in FIG. 4. There must be an intake opening 19 and at least perforated screen 33 thereover. There must be pump 29 and driver 30 with connection 31 going to manifold 32, the latter also being necessary. The central drain 11/11*a* with the opening and closure valve associated therewith for filling or emptying the tank is also critical. Nevertheless, the other features described are optimal and produce substantial new and useful results when employed with the basic combination. Such features and functions have previously been described.

Typically the second screen 33 is not removable unless the fittings bolting the pump intake to each side of side wall 18 are removed. The basic purpose of this screen is to protect the hands of the operator from coming into contact with any of the moving parts of pump 29. The holes or openings in screen 33 are larger in diameter or size than the holes in walls 37 and 38 because of the relative volume of water that has to go through the much smaller (in area) inner screen 33.

The manifold 32 is self draining back through pipe 31, pump 29, opening 19 and thence to the preferably screened-in space next to screen 33, thereafter to the center drain.

While it is preferred that tank 9 have its own input faucet 28, it is feasible to have an elongate faucet (not seen) in the rinse tank which can be pivoted over tank 9 and then back over tank 47.

In the scraping and/or scrapping tank 45, the operator does not spend a lot of time in manual scraping and spraying of the pots and pans. The point is to get the worst and largest quantities of leftover food out of the pan so that a lot of loose food will not go into tank 9 or 46. Thus, the food materials in the pots and pans that are removable easily and quickly, such as those which are not burned or encrusted thereon, as well as readily scrapeable quantities of grease are taken out in this preliminary stage.

The water in the tank typically may be changed every 6 to 8 hours, or oftener if necessary. A typical schedule would be 6 A.M., 2 P.M. and 10 P.M. In a 24 hour shift, without interruption, the running intervals between water changes and cleanings of tank 9 again would, typically, be 6 to 8 hours.

The subject device and the system within which it works (FIG. 7) is equally efficient in peak or slow periods of business. It saves on expensive labor costs. It improves kitchen efficiency and cleanliness. It also improves results in and impresses the officials of health department inspections. The turnover of pots and pans is vastly improved (such returned to useability). The sanitation standards are improved and, overall, the pots and pans taken out of the washer, per se and the entire system of FIG. 7 are cleaner than with the prior art devices. With respect to the workers, job satisfaction and working conditions are substantially improved. This device also reduces employee turnover in these normally relatively distasteful tasks.

In many ordinary systems without the cleaning device and system which are here disclosed, the cook typically dirties the pots and pans which then sit around, drying and becoming far more difficult to clean or such are filled with water to soak in a stack in a sink which actions do not move the pots and pans towards reuseability. The subject device offers a place to get the pots and pans into working, cleaning detergent containing water quickly. Once the pots and pans are in this washer, the water, per se, the pump action, the temperature of the water and the detergent in the water are all working in concert to effectively clean them. The labor is cut so much that, rather than having separate persons for dishwashers and pot and pan cleaners, a utility man may work between the two stations, washing the dishes at intervals and doing the pots and pans at other intervals. The time to effectively clean typical pots and pans in the washer tank 9 usually varies from 5 to 20 minutes. Using a device such as this to clean air filters, mechanical parts and the like, the device may be run overnight in continuous circulation.

The object is to provide the pots and pans leaving the washer tank 9 as free as possible of soils, grease and food residues. The operator, when putting the pots and pans into or taking them out of the washer may use a scratch pad to wipe off the articles going into and coming out of washer 9. The main object of rinse tank 47 following washer tank 9/46 is to remove all of the detergent from the clean pots and pans. It is entirely optional whether to stop the circulation and degrease the circulating water in tank 9 without actually fully emptying the tank and cleaning it out.

It should be understood that the presence of an actual faucet 28 at tank 9 or in tank 9, the presence of an actual overflow system including opening 23 and pipes 15*a* and 15, as well as the use of a heating element and the outer screen 37–41, inclusive are all optional, one, several or all. However, in order to have the full versatility, advantages and useability as described, these features must be present in the relationships described. Additionally, it is optional to somewhat vertically stagger the pipes 21 and nozzles 22 with respect to one another. In such case opening 23 would be positioned above the uppermost nozzles 22. This however, does not help the circulating action and requires, in some cases, special manifold structure. Typically, in a four foot long tank 9, four nozzles are employed 9.6 inches apart and in a three foot long tank three nozzles, likewise, are employed 9.6 inches apart.

The rear wall height is not critical, so long as it is at least as high as the other tank walls. The back wall can carry the input pipes 21 and nozzles 22, as well as overflow opening 23 without extra height. However, if a faucet 28 is present, typically, the back wall should be higher to accomodate the faucet plumbing. The back wall height is also useful as a splash barrier.

With the heating element 36, there is typically provided a conventional thermostat coupled to a conventional sensor of heat within the tank water which will operate to energize and turn off the power to the heating element as the water temperature in the tank varies. There also should be a shut off for the heating element when the water level in the tank drops to adjacent the heating element. This can be done with a conventional float control cooperating with a switch, such float positioned in the tank near front wall 16 and screen 37 and, typically, enclosed for protection from the pots and pans.

It would be very unusual to employ a square washing tank of the construction shown and described. Because of the limitation of horizontal depth of the tank (for example, for permitting the tank to enter doors), cutting down the elongate dimension also will not enable cleaning of many pots and pans. The reason that the jets are positioned on the rear wall (or at least on a long wall) is that, by being in this position, they need only throw the water a relatively short distance to the front wall. If they were placed on the side walls or one of them, a great deal of pump pressure would be required to drive the water jets in the body of water the full length of the tank. Likewise, the rear wall jet positioning enables the concentration of the pump inlet and heating element in the same zone at one side with a maximum volume of the tank clear for washing action. The reason for placing the overflow opening 23 and faucet 28 (if one or both is present) to the left with respect to the specific tank shown is because of the presence of the manifold to the right in the views of FIGS. 1-3, inclusive. With overflow opening 23, there must be room for pipe 15*a*, and, with respect to faucet 28, there must be room for plumbing to pipes 24 and 25 or whatever structure is employed with the faucet.

Figure 5:
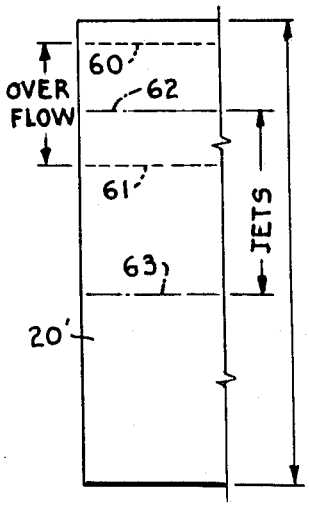
FIG. 5 is a fragmentary view of a portion of the rear wall of the subject pot and pan washer showing the optimum ranges of positioning feasible for the jet nozzles and the overflow outlet opening in a 25 inch deep tank.

Looking at FIG. 5, therein is shown a portion of the 25 inch height of a rear wall 20' in a tank where the side and front walls are also 25 inches in height. The space between lines 60 and 61 define the most effective positions for the overflow opening with respect to this height of wall. The space between lines 62 and 63 define the optimum ranges wherein the discharge openings of the jet nozzles 22 may be placed on such wall. Generally speaking, the overflow opening would move proportionally downwardly as the input pipes for the jets or jet nozzles 22 are moved downwardly and vice versa. The discharge openings of the jet nozzles are always underwater. The overflow opening 23 is always spaced above the jet discharges and preferably above the jet inlet pipes 21. The jet angle should be such that water emitted therefrom would move across the vessel and impact on the front portion of the bottom floor 10 near front wall 16 whereby to deflect off such bottom floor portion forwardly and upwardly to impact then on the front wall 16. From this latter impact, the water current flow tendency would be to move both upwardly and rearwardly, thus to obtain the desired circulation pattern. As the water returns rearwardly from the front wall, continuously being impelled by more water following it, it reaches the zone of entrainment by the continuous jets from the nozzles 22 and thus again moves downwardly and forwardly essentially therewith.

Figure 6:
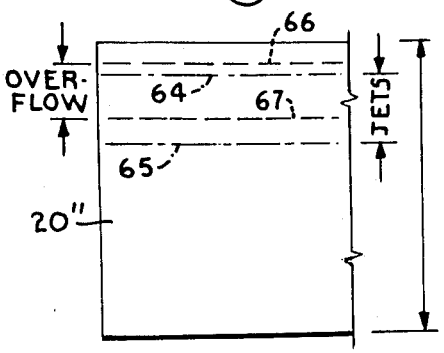
FIG. 6 is a fragmentary view of a portion of the rear, jet carrying wall of the subject device and showing thereon the feasible ranges of positioning of the jet nozzles and the overflow outlet opening in a 15 inch deep tank.

Looking at FIG. 6, the jet nozzles 22 in this 15 inch deep tank (all four walls being 15" deep, including all or the lower part of rear wall 20") may be positioned between lines 64 and 65 for optimum action. The overflow opening 23 optimally will be positioned between lines 66 and 67. As mentioned, the overflow opening is always above the highest jet nozzle and preferably above the jet input pipes 21.

Looking at FIGS. 5 and 6, the optimum positioning for the jets and overflow opening in each case is essentially central of the ranges designated. That is, preferably, in the 25 inch deep tank of FIG. 5, the jet nozzle openings are positioned centrally of the distance between fines 62 and 63 and so angled as to have the line of motion of the water from the jets as seen at 22*a* in FIG. 4 and 51 in FIG. 8. Yet additionally, with those nozzles there positioned, the overflow opening would optimally be midway between line 60 and 61. As the jet nozzle openings would proportionally rise, so should the overflow opening and vice versa. The same is true with respect to the height ranges seen in FIG. 6 with respect to a 15 inch deep tank.

In a 20 inch deep tank, typically, the overflow opening 23 is preferably located 17 inches above the bottom wall of the tank, directly in the middle of the overflow opening position range. Likewise, in a 20 inch deep tank, the centers of the jet nozzles 23 are preferably located 13 inches from the bottom of the tank and directly in the middle of the optimum jet nozzle range.

With respect to typical or preferred depth for the washing device in question, the optimum range for performance is between 15 inches and 25 inches. Normal depth is 20 inches.

With respect to the jet nozzles, the pipes going into the tank are externally threaded so that the jet nozzle members are internally threaded at one end thereof to thread thereon. There is a nut in the tank having an O ring on at least one face thereof which operates to screw against the back wall of the tank with one side thereof, the other side of which has the inboard end of the jet nozzles screwed thereagainst, abutting the O ring on the nut face. There may be provided two O rings, one on each face of the said nut (or two nuts, each with an O ring on one face thereof), whereby there is an O ring seal of the pipe against the back wall and an O ring seal against the base of the jet nozzle.

The water flow from the jet nozzles will tend to move the pots and pans around, if they are not jammed together, until such typically are pinned to one side or the other. If there are no pots and pans in the tank when the water is circulating, there are different water levels at the front and back of the tank. If the jet nozzles were not pointed downwardly, then, overflow at and over the front wall very well could be a serious problem.

In a three foot long tank, three jets being therein employed, there are thus four spaces between and on each side of the jets from side wall to side wall. This means nine inches between the jet nozzles themselves and the adjacent walls. With a four foot long tank, four jets are employed which gives five spaces between the jets and the wall. These jets, then, would be 9.6 inches from the walls and one another. In a five foot long tank, five jets would be employed, thus providing six spaces between the jets themselves and the wall. In this case, there would be 10 inches between the jet themselves and the adjacent walls.

Other aspects of the invention include:

(1) The pump is placed on the end of the machine, not behind it or in front of it or below it.

(2) The manifold goes behind the rear wall and covers the evenly spaced jets.

(3) This device is definitely, preferably, a longer (rectangular) than wide or horizontally deep device. A square device with three jets would be about the only instance of a square useable device on a practical basis. Four feet wide and four feet deep would make for a very large, very deep machine with the operator's access to the rear portion of the tank very difficult. Five feet long and five feet horizontally deep would be even more objectionable.

While a stripped down device will function in a useful manner, the following are additional elements of importance to the device:

(1) The reversability of the direction of operation;

(2) The jets evenly spaced with respect to one another and the side walls;

(3) That the water in the tank is heated and maintained at a certain temperature level;

(4) That a removable screen be provided which both operates to prevent clogging of the pump system and jets, but also operates to protect the pump and heater element; and (5) An overflow opening as described.

From the foregoing, it will be seen that this invention is one well adapted to attain all of the ends and objects hereinabove set forth together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

We claim:

1. A pot and pan washing device comprising, in combination:

(1) a tank having substantially rectangular bottom, side, front and rear walls connected substantially at right angles to one another, so as to be substantially rectangular in plan view from above, (2) the side, front and rear walls being normally substantially vertical and the bottom wall normally substantially horizontal in operative orientation, (3) a drain opening substantially in the center of the bottom wall with a first drain pipe connected thereto and leading downwardly away therefrom, said opening having a valve associated therewith operable to open and close said drain opening, thus allowing filling and emptying of said tank, (4) a plurality of substantially uniformly spaced apart liquid dispensing pipes and nozzles thereon provided on said rear wall, said pipes extending through the rear wall into said tank, said pipes and nozzles all positioned on substantially the same vertical level and spaced substantially equal distances from one another and the side walls, (5) an overflow opening provided in said rear wall, there being a second drain pipe connected to said overflow opening outside of said tank and leading downwardly to a connection with said first drain pipe below the valve therein, (6) a pump having an intake connection and intake opening through one of said side walls positioned somewhat above the bottom wall, as well as an output connection from said pump extending at least substantially to said rear wall, (7) a manifold connecting together all of said liquid dispensing pipes positioned behind said rear wall and having said pump output connection communicating therewith, whereby said pump can pump liquid from inside said tank through said pump output connection and manifold into said liquid dispensing pipes and nozzles in liquid circulating manner, (8) a heating element connecting through said front wall and extending rearwardly in said tank adjacent to the side wall having said pump intake connection therethrough, said heating element positioned in the lower portion of said tank, (9) at least one faucet provided on said rear wall with hot and cold water pipe connections thereto extending through said rear wall, there being valves on said pipe connections whereby to control the relative quantities of hot and cold liquid flowing out of said faucet,

(10) a first, removable, perforated screen enclosure being provided at and adjacent to the side wall carrying said pump intake connection, said screen enclosure removably enclosing therewithin said heating element and said pump intake opening,

(11) the heating element and the pump intake connection positioned below said liquid dispensing pipes and nozzles, the latter positioned below said overflow opening and the latter positioned below said water pipe connections,

2. A device as in claim 1 wherein the pump intake connection and said overflow opening are positioned at substantially opposite sides of said tank.

3. A device as in claim 1 including a second perforated screen enclosure positioned over said pump intake opening within said first, removable, perforated screen enclosure.

4. A device as in claim 1 wherein the first, removable, perforated screen enclosure is made up of a first, normally vertical perforated wall extending from the tank front wall to the tank rear wall and substantially parallel to the adjacent tank side wall and a second, normally horizonal top perforated wall extending from the top of said normally vertical perforated wall to the adjacent side wall.

5. A device as in claim 1 wherein the front and side walls of the tank are all of substantially the same height and the liquid dispensing pipes and nozzles and the overflow opening are all positioned below the top edges of said front and side walls.

6. A device as in claim 1 wherein the front and side walls of the tank are all of substantially the same height and the liquid dispensing pipes and nozzles and the overflow opening are all positioned below the top edges of said front and side walls, the rear wall of the tank being of greater height than the other tank vertical walls and the water pipe connections being positioned thereon above the top edges of the tank side and front walls.

7. A device as in claim 1 wherein said nozzles are so directed and aimed that the streams of water therefrom, if not deflected or impeded by objects in said tank, normally impact on said bottom wall closely adjacent the lower edge of said front wall.

8. A device as in claim 7 where in the connection between the front and bottom walls inside said tank is faired, filleted or rolled along its length, whereby to tend to deflect liquid driven from said nozzles first downwardly and forwardly against the forward portion of said bottom wall and then forwardly and upwardly against and from said front wall for return toward said rear wall.

9. A device as in claim 1 wherein the connection between the front and bottom walls inside said tank is faired, filleted or rolled along its length, whereby to tend to deflect liquid driven from said nozzles first downwardly and forwardly against the forward portion of said bottom wall and then forwardly and upwardly against and from said front wall for return toward said rear wall, the connection between the rear and bottom walls inside said tank being also faired, filleted or rolled along its length whereby to deflect liquid circulating downwardly adjacent said rear wall forwardly somewhat against and somewhat parallel to said bottom wall.

10. A pot and pan washing device comprising, in combination:

(1) a tank having substantially rectangular bottom, side, front and rear walls connected substantially at right angles to one another, so as to be substantially rectangular in plan view from above, (2) the side, front and rear walls being normally substantially vertical and the bottom wall normally substantially horizontal in operative orientation, (3) the front and rear walls being of substantially greater length than said side walls, (4) a drain opening substantially in the center of the bottom wall with a first drain pipe connected thereto and leading downwardly away therefrom, said opening having a valve associated therewith operable to open and close said drain opening, thus allowing filling and emptying of said tank, (5) a plurality of spaced apart, liquid dispensing pipes and nozzles thereon provided on said rear wall, said pipes extending through the rear wall into said tank, (6) a pump having an intake connection an intake opening through one of said side walls, said intake opening positioned somewhat above the bottom wall and subtantially below said nozzles, there being, as well, an output connection from said pump extending at least substantially to said rear wall, (7) a manifold connecting together all of said liquid dispensing pipes positioned behind said rear wall and having said pump output connection communicating therewith, whereby said pump can pump liquid from the inside of said tank through said pump output connection and manifold into said liquid dispensing pipes and nozzles in liquid circulating manner, (8) a screen surrounding the intake connection to said pump, (9) said nozzles so oriented as to jet streams of water into said tank against the bottom wall of said tank closely adjacent the front wall connection thereto whereby to normally provide a continuous, circulating flow within said tank from said nozzles to the front portion of the bottom wall and therefrom to and against said front wall whereby to return to said back wall and thence return to said bottom wall for entrainment with the flow from the nozzles,

(10) the normal operating liquid level in said tank being above all of said nozzles positioned near said rear wall.

11. A device as in claim 10 including an overflow opening provided in said rear wall above said nozzles, there being a second drain pipe connected to said overflow opening outside of said tank and rearwardly of said rear wall thereof, said second drain pipe leading downwardly to a connection with said first drain pipe below the tank drain opening valve.

12. A device as in claim 10 including a heating element connecting through said front wall into said tank and extending rearwardly in said tank adjacent to the side wall having the said pump intake connection therethrough, said heating element positioned in the lower portion of said tank.

13. A device as in claim 10 including a heating element connecting through said front wall into said tank and extending rearwardly in said tank adjacent to the side wall having the said pump intake connection therethrough, said heating a removable, perforated screen enclosure being provided at and adjacent to the side wall carrying said pump intake connection and having said heating element adjacent thereto, said screen enclosure removably enclosing therewithin said pump intake connection and said heating element.

14. A device as in claim 10 including at least one faucet provided on said rear wall with hot and cold water pipe connections thereto, at least said faucet extending through said rear wall into said tank, there being valves on said water pipe connections operative to permit control of the level of quantities of hot and cold liquid flowing out of said faucet.

15. A device as in claim 10 including an overflow opening provided in said rear wall above said nozzles, there being first drain pipe below the tank drain opening valve, a second drain pipe connected to said overflow opening outside of said tank and rearwardly of said rear wall, said drain pipe leading downwardly to a connection with said there being at least one faucet provided on said back wall with hot and cold water pipe connections thereto, at least said faucet extending through said rear wall into said tank, there being valves on said hot and cold water pipe connections operative to permit control of the level of quantities of hot and cold liquid flowing out of said faucet, said water pipe connections being positioned above the level of said overflow opening.

16. A device as in claim 10 including an overflow opening provided in said rear wall above said pipes and nozzles, there being a second drain pipe outside of said tank and rearwardly of said rear wall connected to said overflow opening said second drain pipe leading downwardly to a connection with said first drain pipe below the tank drain opening valve, at least one faucet provided on said back wall with hot and cold water pipe connections thereto, at least said faucet extending through said rear wall into said tank, there being valves on said pipe connections operative to permit control of the level of quantities of hot and cold liquid flowing out of said faucet, said faucet positioned on said rear wall above said overflow opening, said overflow opening and said faucet positioned at substantially the opposite end of said tank from said pump intake opening and further positioned laterally of the last pipe and nozzle in said plurality thereof positioned furthest away from said intake connection.

17. A device as in claim 10 including removable, perforated screen enclosure being provided at and adjacent to the side wall carrying said pump intake connection, said screen enclosure removably enclosing therewithin said pump intake connection.

18. A device as in claim 10 wherein the connection between the front and bottom walls inside said tank is faired, filleted or rolled along its length, whereby the liquid from said nozzles first impacts on the forward portion of said bottom wall then passes forwardly and upwardly, impacting against said front wall and thereafter moves rearwardly from said front wall toward said rear wall.

19. A device as in claim 10 wherein the connection between the front and bottom walls inside said tank is faired, filleted or rolled along its length, whereby said liquid from said nozzles flows first downwardly and forwardly against the forward portion of said bottom wall and then forwardly and upwardly, impacting against said front wall and thereafter moves rearwardly therefrom toward said rear wall, the connection between the rear and bottom walls inside said tank also being faired, filleted or rolled along its length whereby to tend to deflect liquid circulating downwardly adjacent said rear wall forwardly somewhat against and somewhat parallel to said bottom wall.

20. A device as in claim 10 wherein said liquid dispensing pipes and nozzles are substantially uniformly spaced apart one from the other on said rear wall, as well as being positioned on substantially the same vertical level.

21. A device as in claim 10 wherein said liquid dispensing pipes and nozzles are substantially uniformly spaced apart, one from the other, on said rear wall, as well as being positioned on substantially the same vertical level, said nozzles also being spaced substantially equal distances from the side walls.

22. A pot and pan washing device comprising, in combination:

(1) a tank having substantially rectangular bottom, side, front and rear walls connected substantially at right angles to one another, so as to be substantially rectangular in plan view from above, (2) the side, front and rear walls being normally substantially vertically and the bottom wall normally substantially horizontal in operative orientation, (3) the front and rear walls being of greater length than said side walls, (4) a drain opening in the bottom wall with a first drain pipe connected thereto and leading downwardly away therefrom, said opening having means associated therewith operable to permit the opening and closing of said drain opening, thus allowing filling and emptying of said tank, (5) a plurality of spaced apart nozzles having liquid dispensing outlets thereon provided adjacent to said rear wall inside said tank, (6) a pump having an intake connection and intake opening through one of said side walls, said intake connection positioned adjacent to the bottom wall, there being, as well, an output connection from said pump extending at least substantially to said rear wall, (7) a manifold connecting together all of said liquid dispensing nozzles, said manifold positioned closely adjacent to said tank rear wall and having said pump output connection communicating therewith, whereby said pump can pump liquid from the inside of said tank through said pump output connection and manifold into and through said liquid dispensing nozzle outlets in liquid circulating manner, (8) a perforated screen covering the intake connection to said pump, (9) a substantial proportion of said nozzles so oriented as to jet streams of water forwardly and downwardly into said tank aganist said bottom wall at a substantial angle thereto, whereby, in tank pot and pan empty condition, to normally tend to provide a continuous, circulating flow within said tank from said nozzles forwardly and downwardly against the bottom wall and therefrom forwardly and upwardly to and against said front wall, whereby to return said water therefrom upwardly and rearwardly towards said back wall,

(10) the normal operating level in said tank being above all of said nozzle outlets positioned near said rear wall.

23. A device as in claim 22 including an overflow opening provided in said rear wall above said nozzle outlets, there being a second drain pipe connected to said overflow opening outside of said tank, said second drain pipe leading downwardly to a connection with said first drain pipe below the tank drain opening valve.

24. A device as in claim 22 including a heating element connecting into said tank and positioned in said tank adjacent to the side wall having the said pump intake connection and opening therethrough, said heating element positioned in the lower portion of said tank, and a removable, relatively finely perforated screen enclosure being provided adjacent thereto, said screen enclosure removably enclosing therewithin both said pump intake connection and opening and said heating element.

25. A device as in claim 22 including a removable, relatively finely perforated screen enclosure being provided at and adjacent to the side wall carrying said pump intake connection and opening, said screen removably enclosing therewithin at least said pump intake connection and opening and a substantial volume of the space in said tank.

26. A device as in claim 22 wherein said liquid dispensing pipes and nozzles are substantially uniformly spaced apart, one from the other, on said rear wall, the two nozzles at the ends of said set thereon also being substantially uniformly spaced apart from the nearly side walls.

27. A device as in claim 22 wherein all portions of the floor of said manifold are so positioned and sited that, upon stopping circulation of the water in and out of said tank, and draining said tank, all the water in the manifold will drain by gravity out through the pump into the tank.

28. A pot and pan washing device comprising, in combination:

(1) a tank having substantially rectangular bottom, side and end walls connected substantially at right angles to one another, so as to be substantially rectangular in plan view from above, (2) the side and end walls being normally substantially vertical and the bottom wall of said tank being normally substantially horizontal in operative orientation, (3) the side walls being of greater length than said end walls, (4) a drain opening in the bottom wall with a first drain pipe connected thereto and leading downwardly away therefrom, said opening having means associated therewith operable to permit the open and closing of said drain opening, thus allowing filling and emptying of said tank, (5) a plurality of spaced apart nozzles having liquid dispensing outlet openings therein provided adjacent to a first one of said side walls in said tank, (6) a pump having an intake connection and intake opening through a first one of said end walls, said intake opening being positioned adjacent to the bottom wall, there being, as well, an output connection from said pump extending at least subtantially to said first side wall outside of said tank, (7) a manifold connecting together all of said liquid dispensing nozzles, such manifold positioned adjacent to said first side wall and said liquid dispensing nozzles, such manifold having said pump output connection communicating therewith, whereby said pump can pump liquid from inside of the tank into said pump output connection and manifold and then into and through said liquid dispensing nozzles into the tank in liquid circulating manner, (8) a perforated screen covering the intake connection to said pump, (9) a substantial proportion of said nozzles so oriented as to jet streams of water into said tank adjacent that portion of the bottom wall leading to said other, second side wall, whereby, in tank pot and pan empty conditions, to normally tend to provide a continuous circulating flow within said tak from said nozzles to adjacent that portion of the bottom wall leading to said second side wall and therefrom upwardly and forwardly to and against said second side wall, whereby to return upwardly and rearwardly from said second side wall toward said first side wall,

(10) the normal operating liquid level in said tank being above all of said liquid dispensing outlet openings positioned adjacent said first side wall.

29. A device as in claim 28 including an overflow opening provided in said first side wall above said outlet openings, there being a second drain pipe connected to said overflow opening outside of said tank, said second drain pipe leading downwardly to a connection with said first drain pipe below the tank drain opening valve.

30. A device as in claim 28 including a heating element connecting through said second side wall into said tank and extending transversely in said tank adjacent to the said end wall having said pump intake connection and opening therethrough, said heating element positioned in the lower portion of the tank.

31. A device as in claim 30 including a removable, relatively finely perforated screen enclosure being provided at and adjacent to the end wall carrying said pump intake connection and having said heating element adjacent thereto, said screen removably enclosing therewithin both of said pump intake opening and said heating element.

32. A device as in claim 28 including an overflow opening being provided in said first side wall above said nozzles, there being a second drain pipe connected to said overflow opening and positioned outside of said tank, said drain pipe leading downwardly to a connection with said first drain pipe below the tank drain opening, at least one faucet provided adjacent to said first side wall with hot and cold water pipe connections thereto, therebeing valves on said pipe connections operable to permit control of the quantities of hot and cold liquid flowing out of said faucet, the outlet of said faucet being positioned adjacent to said first side wall and above said overflow opening, said overflow opening and faucet being positioned at substantially the opposite end of said tank from said pump intake opening.

33. A device as in claim 28 including as removable, relatively finely perforated screen enclosure being provided at and adjacent to the end wall carrying said pump intake connection and opening, said screen enclosure removably enclosing therewithin at least said pump intake opening and a substantial volume of the space in said tank.

34. A device as in claim 28 wherein said liquid dispensing nozzles are substantially uniformly spaced apart, one from the other, on said first side wall, as well as being positioned on substantially the same vertical level, two of said nozzles also being spaced substantially equal distances from the end walls of said tank.

35. A device as in claim 28 wherein all portions of the floor of said manifold are so positioned and sited that, upon stopping circulation of the water in and out of said tank, and draining said tank, all of the water in the manifold will drain out by gravity through the pump into said tank.

36. A pot and pan washing device comprising, in combination:

(1) a tank having subtantially rectangular bottom, side, front and rear walls connected substantially at right angles to one another, so as to be substantially rectangular in plan view from above, (2) the side, front and rear walls being normally substantially vertical and the bottom wall being normally substantially horizontal in operative orientation, (3) the front and rear walls being of greater length than said side walls, said tank, when filled holding a substantial body of water therein, (4) a drain opening positioned in said bottom wall with a first drain pipe connected thereto and leading downwardly away therefrom, (5) means associated with said drain opening for alternatively closing and opening same, thus allowing filling and emptying of said tank, (6) a plurality of spaced apart, liquid dispensing pipes provided on said rear wall, said pipes extending through said rear wall into said tank and having flow directing openings on the ends thereof within said tank, (7) a pump having an intake connection and intake opening extending through a first one of said side walls, said intake opening positioned adjacent to but somewhat above the bottom wall there being, as well, an output conduit from said pump extending at least substantially to said rear wall, (8) a manifold connecting together all of the portions of said liquid dispensing pipes that extend through said rear wall, the pump conduit connecting to a lower portion of said manifold whereby said pump can pump liquid from the lower portion of the inside of said tank through said pump output conduit and manifold into said liquid dispensing pipes and from there into said tank in liquid circulating manner, (9) a perforated screen covering the intake opening of said pump within said tank,

(10) a substantial proportion of said flow directing openings so oriented as to jet streams of water which, if not deflected by objects in said tank, pass into the said body of water in said filled tank forwardly across at least a substantial portion of the bottom wall of said tank,

(11) the normal operating liquid level in said tank, when full, being above all of said flow directing openings.

37. A device as in claim 36 including a removable, relatively finely perforated screen enclosure being provided at and adjacent to the side wall carrying said pump intake connection and opening, said screen enclosure removably enclosing therewithin at least said pump intake connection and a substantial volume of the space in said tank.

38. A device as in claim 36 including a heating element connecting through said front wall into said tank and extending rearwardly in said tank adjacent to the side wall having the said pump intake connection and opening therethrough, said heating element being positioned in the lower portion of said tank, and a removable, relatively finely perforated screen enclosure being provided at and adjacent to the side wall carrying said pump intake connection and opening and having said heating element adjacent thereto, said screen enclosure removably enclosing therewithin said pump intake connection and said heating element.

39. A device as in claim 36, including an overflow opening provided in said rear wall above said flow directing openings, there being a second drain pipe connected to said overflow opening outside of said tank, said second drain pipe leading downwardly to a connection with said first drain pipe below the tank drain opeing valve.

40. A device as in claim 36 including a heating element connecting through said front wall into said tank and extending rearwardly in said tank adjacent to the side wall having the said pump intake connection and opening therethrough, said heating element positioned in the lower portion of said tank.

41. A device as in claim 36 wherein all portions of the floor of said manifold are positioned and sited so that, upon stopping circulation of the water in and out of said tank, and draining said tank, all the water in the manifold will drain out by gravity through the pump into said tank.

42. A device as in claim 36 including an overflow opening being provided in said rear wall above said flow directing openings, there being a second drain pipe connected to said overflow opening and positioned outside of said tank, said second drain pipe leading downwardly to a connection with said first drain pipe below the tank drain opening, at least one faucet provided on said back wall with hot and cold water pipe connections thereto, at least said faucet extending through said rear wall into said tank, there being valves on said pipe connections operative to permit control of the relative quantities of hot and cold liquid flowing out of said faucet, the outlet of said faucet being positioned adjacent said rear wall and above said overflow opening, said overflow opening and said faucet positioned at substantially the opposite end of said tank from said pump intake opening and further positioned laterally of the last flow directing opening in said plurality thereof positioned furtherest away from said intake connection.

43. A device as in claim 36 wherein said liquid dispensing pipes are substantially uniformly spaced apart one from the other on said rear wall, as well as being positioned on substantially the same vertical level.

* * * * *